US006385942B1

(12) United States Patent
Grossman et al.

(10) Patent No.: US 6,385,942 B1
(45) Date of Patent: May 14, 2002

(54) BUILDING PANELS

(75) Inventors: Lawrence M. Grossman, Spokane; L. Myles Phipps, Shelton; Jon R. Sayler; Werner Nennecker, both of Spokane, all of WA (US)

(73) Assignee: ACSYS Inc., Hayden, ID (US)

( * ) Notice: Subject to any disclaimer, the term of this patent is extended or adjusted under 35 U.S.C. 154(b) by 0 days.

(21) Appl. No.: 09/431,146

(22) Filed: Nov. 1, 1999

(51) Int. Cl.[7] ..... E04C 2/32

(52) U.S. Cl. ..... 52/798.1; 52/800.12; 52/630

(58) Field of Search ..... 52/92.2, 93.1, 52/309.7, 309.16, 592.1, 630, 789.1, 798.1, 799.1, 800.18, 800.12

(56) References Cited

U.S. PATENT DOCUMENTS

| | | | | |
|---|---|---|---|---|
| 2,095,434 A | | 10/1937 | Calkins | |
| 2,257,001 A | | 9/1941 | Davis | |
| 2,270,161 A | | 1/1942 | Briggs | |
| 3,239,982 A | | 3/1966 | Nicosia | |
| 3,400,969 A | * | 9/1968 | Ahrens | 52/798.1 X |
| 3,562,985 A | | 2/1971 | Nicosia | |
| 3,605,353 A | | 9/1971 | Marcott | |
| 3,665,662 A | | 5/1972 | Timbrook | |
| 3,771,277 A | | 11/1973 | Rausch | |
| 3,778,949 A | | 12/1973 | Hellerich | |
| 4,206,267 A | | 6/1980 | Jungbluth | |
| 4,236,361 A | | 12/1980 | Boden | |
| 4,260,569 A | | 4/1981 | Hurst | |
| 4,435,928 A | | 3/1984 | Huling | |
| 4,486,996 A | | 12/1984 | Alejos | |
| 4,517,782 A | | 5/1985 | Shamszadeh | |
| 4,630,418 A | | 12/1986 | Degut | |
| 4,858,398 A | | 8/1989 | Ricchini | |
| 4,870,788 A | | 10/1989 | Hassan | |
| 4,924,644 A | | 5/1990 | Lewis | |
| 4,927,696 A | | 5/1990 | Berg | |
| 5,072,569 A | * | 12/1991 | VanTassel | 52/309.16 X |
| 5,245,803 A | | 9/1993 | Haag | |
| 5,497,589 A | * | 3/1996 | Porter | 52/309.7 |
| 5,509,242 A | | 4/1996 | Rechsteiner | |
| 5,551,204 A | * | 9/1996 | Mayrand | 52/799.1 X |
| 5,612,117 A | * | 3/1997 | Bélanger et al. | 52/789.1 X |
| 5,619,837 A | * | 4/1997 | DiSanto | 52/630 X |
| 5,763,043 A | | 6/1998 | Porter | |
| 5,822,940 A | * | 10/1998 | Carlin et al. | 52/309.7 X |
| 5,867,949 A | * | 2/1999 | Untiedt | 52/93.1 X |

FOREIGN PATENT DOCUMENTS

| | | |
|---|---|---|
| FR | 2566030 | * 12/1985 |

* cited by examiner

*Primary Examiner*—Beth A. Stephan
(74) *Attorney, Agent, or Firm*—Harold James; Robert L. Epstein; James & Franklin, LLP

(57) ABSTRACT

A pre-formed building panel comprising a metal core substantially completely encapsulated in a low density material and acting as a reinforcement member therein, that member comprising first and second sets of lengthwise-extending segments at different elevations within the panel and connected to adjacent segments of the opposite set by generally vertically extending segments, the panel optionally being provided at its side edges with portions adapted to be overlapped with corresponding portions of an adjacent panel, the panels being provided with metal edge plates at top and bottom, those edge plates optionally having a width less than the width of the panel, the general vertically extending segments being provided with relatively large holes spaced lengthwise therealong while the segments of the first and second sets are substantially free of holes, with the metal reinforcement member optionally carrying a vertical wall extending from a side edge of said member, the segments of said first and second sets, the edge plates and that vertically extending wall, if present, facilitating the attachment of external objects to the panel, an optional adapter plate fitting over the upper edge of the panel and having an inclined top wall to which roof elements and the like may be attached if desired.

18 Claims, 9 Drawing Sheets

FIG. 13
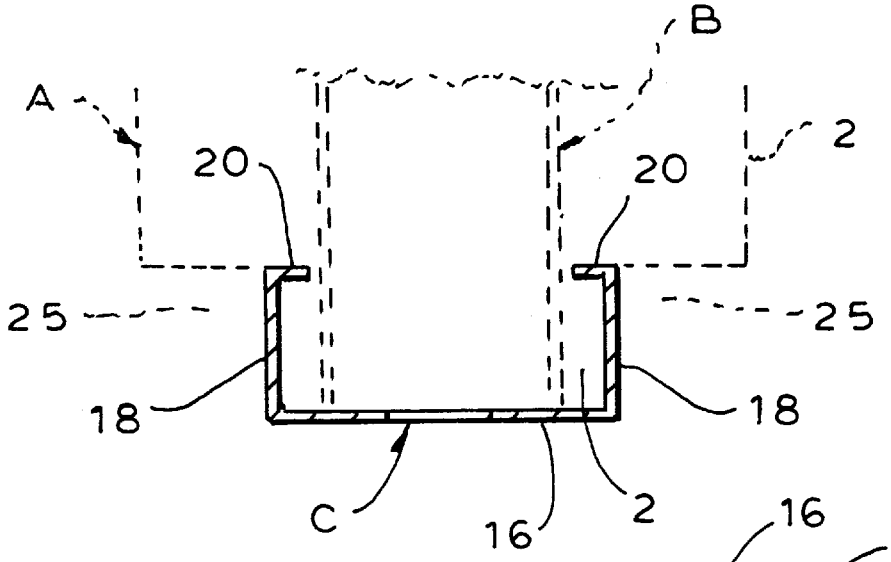
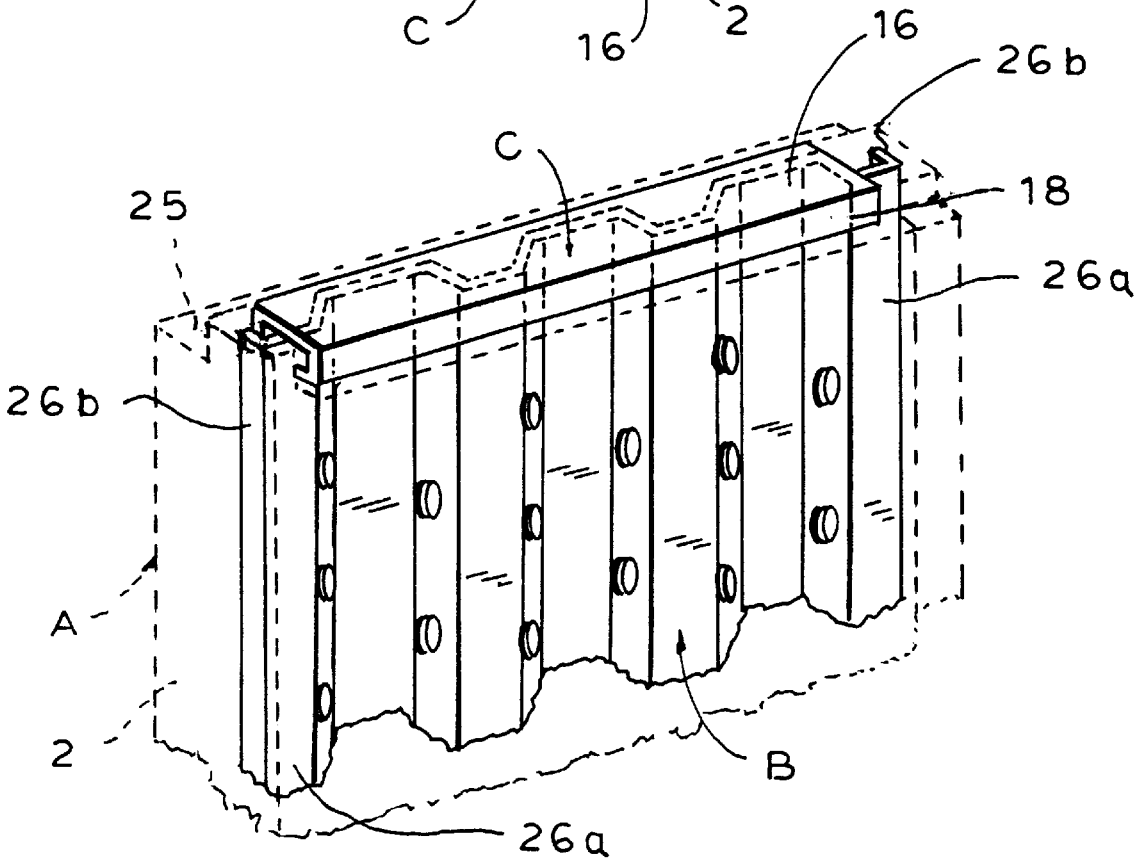
FIG. 14

BUILDING PANELS

This invention relates to the construction of pre-formed panels suitable for use, for example, in the fabrication of walls, floors, ceilings, roofs and the like in buildings.

BACKGROUND OF THE INVENTION

There is a constant need for low-cost shelters that are easily and quickly erected, and that are formed from readily transportable materials. For instance, much of the world's population is relatively poor, and many live in areas where natural resources are scarce. Accordingly, it would be desirable to develop low-cost shelter constructions which could be transported and erected at population centers throughout the world. The need for low-cost shelter construction is, of course, not limited to remote or foreign areas, but instead exists in various places in this country where low-cost housing is needed.

Flexible materials, such as canvas, can be utilized to create low-cost and easily erected dwellings. However, such materials typically do not provide adequate insulation for most climates. Also, many of the commonly utilized flexible materials, such as canvas and plastic sheets, rapidly degrade upon exposure to certain common environmental conditions, such as moisture and/or ultraviolet light.

Small, portable and relatively durable buildings have been designed and constructed in the past. Some of these buildings have been readily assembled from pre-formed panels. However, the building components for such constructions are frequently quite heavy and bulky and thereby cause storage and handling problems. Additionally, it is generally desired to provide plumbing and electrical conduits within building structures. Frequently it is time-consuming and difficult to provide such plumbing and electrical conduits in those buildings constructed from known types of pre-formed panels.

Prior art panels of the general type here under discussion have comprised a foamed material encapsulating a reinforcement which takes the form of a metal sheet, sometimes provided in corrugated or wavy form and sometimes provided with a multiplicity of openings through which the foamed material passes. Such constructions, by reason of the extent and location of those openings, lack optimum strength and also minimize the ability of the reinforcement to act as a foundation for the attachment of external elements to a given panel.

In addition, obtaining adequate sealing between adjacent panels is often difficult and, because metals are usually good transmitters of heat, panels containing metal parts are often deficient in heat insulative properties. Also, the side edges of the panels may be defined by portions of reduced thickness when compared with the remainder of the panel, thus permitting those portions of reduced thickness to overlap when the panels are assembled.

SUMMARY OF THE INVENTION

In accordance with the present invention, the panel includes an encapsulated strong reinforcement member, preferably but not necessarily of sheet metal, which is so shaped as to provide a plurality of sets of longitudinally extending segments which are spaced from one another both vertically and laterally, each segment being connected to the adjacent segments by generally vertical and preferably inclined segments, and optionally with one or more vertically extending walls at the side extremities of the reinforcement member. The first and second sets of segments are generally planar and extend generally horizontally. The vertically extending segments are also generally planar. The holes in the reinforcement member through which the foaming material may pass are relatively large and spaced substantially from one another. They are provided essentially only in the generally vertically extending segments and for all practical purposes not at all in the segments of the first and second sets, thereby to significantly increase the ultimate strength of the panel while at the same time effectively providing for communication of the encapsulating material between front and back of the reinforcement member, and facilitating the attachment of the panel to external elements by using attaching elements such as screws which pass through a given horizontal segment or a vertically extending wall if provided. Thus, the panels are totally load bearing and screw attachment is through generally flat fully load bearing surfaces, and attachment of or to external objects is readily accomplished without any deterioration in strength.

In addition, defective sealings between adjacent panels can be achieved by providing those panels, along their side edges, with overlapping parts including the foamed material. Moreover, when, as is preferred, the top or bottom edges of the panel are provided with metal caps, those caps do not extend the full width of the panel, thus producing gaps at the upper or lower corners of the panel. Those gaps are filled with heat insulating materials such as the foamed material used throughout the remainder of the panel, thereby minimizing the heat-transmitted character of the panel.

As a result, building components that are readily transported and assembled in locations throughout the world can be provided with suitable insulative properties and which will be relatively resistant to weather and degradation, thereby to provide comfortable dwellings and other structures in a diversity of the world's regions.

BRIEF DESCRIPTION OF THE DRAWINGS

Preferred embodiments of the present invention are illustrated in the following drawings, in which:

FIG. 13 is a cross-sectional view taken across the thickness of a panel and showing one embodiment of an edge plate adapted to be secured to the upper and lower extremities of the reinforcement member;

FIG. 14 is an enlarged perspective view of the upper portion of FIG. 2 but in which a reinforcement member of the type disclosed in FIGS. 7 and 12 is provided;

DESCRIPTION OF THE PREFERRED EMBODIMENTS

Figure 1:
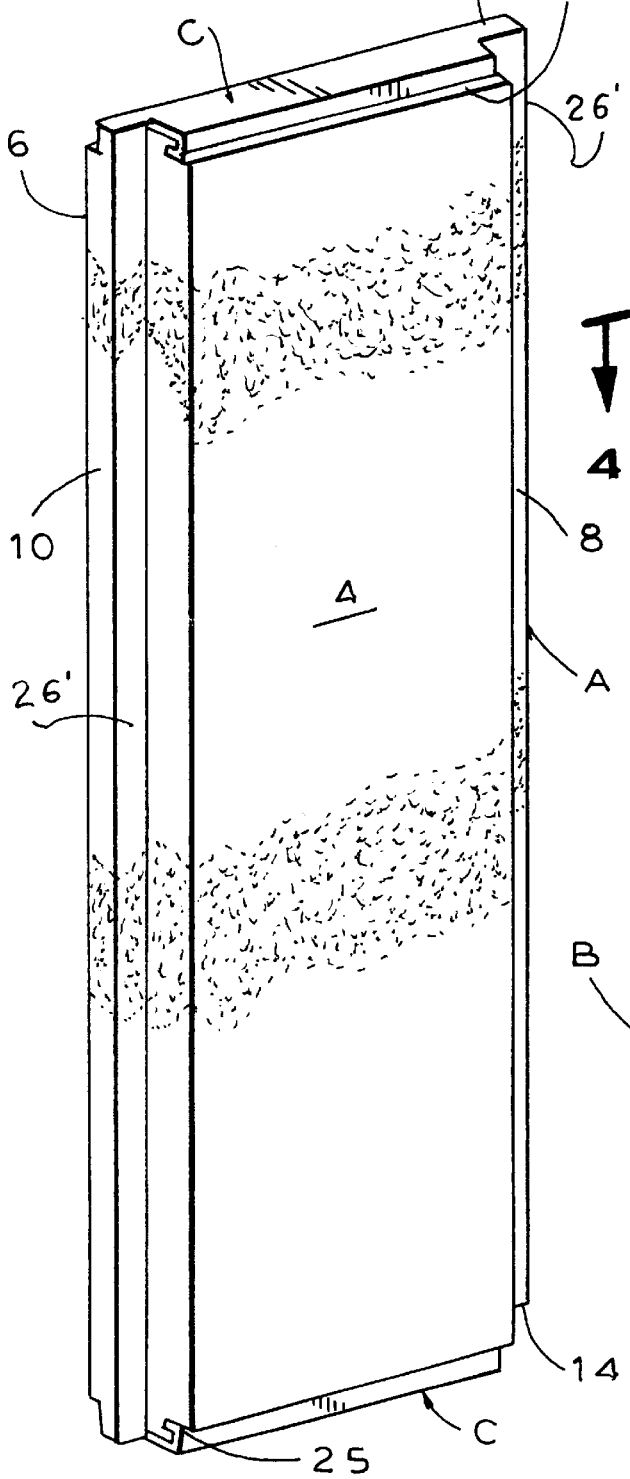
FIG. 1 is a three-quarter perspective view of one embodiment of a complete panel of the present invention.
Figure 2:
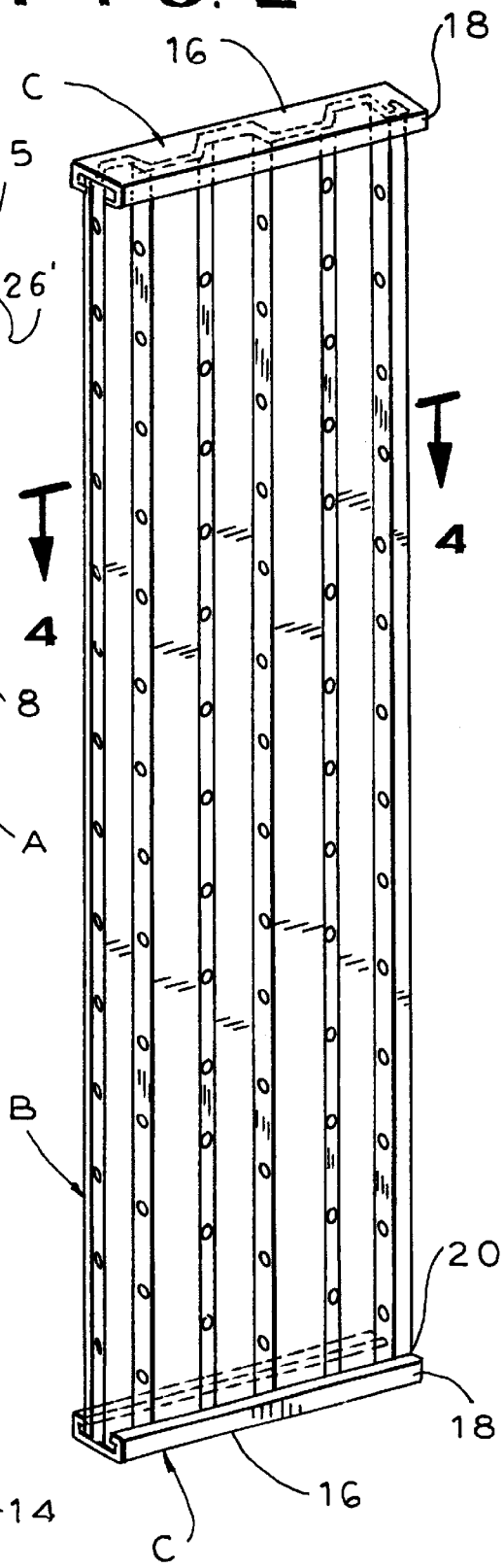
FIG. 2 is a three-quarter perspective view of one embodiment of a reinforcement member with edge plates attached.

A typical building panel, generally designated A, is shown in FIG. 1. It comprises a body of low-density material 2 which encapsulates a strength-producing reinforcement member, generally designated B, one version of which is shown in FIG. 2. The resulting panel has a front surface 4 and a rear surface 6, side surfaces 8 and 10 and top and bottom surfaces 12 and 14. All of the surfaces 4, 6, 8, 10 are preferably constituted by the low-density material, while the upper and lower surfaces 12 and 14 are constituted by edge plates generally designated C which are secured to the upper and lower edges of the reinforcement member B in any appropriate manner, as by welding, so as to extend across the width and at least part of the thickness of the panel. The panel A is preferably formed by placing the reinforcement member B with edge plates C attached in a mold which contains embryonic low-density material and causing that low-density material to fill the mold and, because the mold is of appropriate size, encapsulate the reinforcement member B as described. A typical panel A may be 16 feet long, 5 feet wide and about 4 inches thick, although it will be obvious that many variations may be made in those dimensions.

The reinforcement member B, as its name implies, is provided to reinforce, add strength to, the low-density material which encapsulates the member B. In the context of this document, low-density material shall mean material having a density of less than about 20 lbs./foot and may comprise a number of materials known to persons of ordinary skill in the art. Such materials include low-density cement or concrete, which may be formed by aerating a cementitious mixture before curing the mixture. Other low-density materials include straw-based filler materials, textile-based filler materials, paper-based filler materials, and foams, such as, for example, polystyrene. A number of the above-listed materials are waste products in various regions throughout the world. Accordingly, the present invention advantageously encompasses utilization of waste products in pre-formed building panels.

The edge plates generally designated C, as may best be seen from FIG. 13, are preferably formed of metal, having a bottom wall 16, upwardly extending side walls 18 and inwardly extending flanges 20. In the edge plate embodiments shown in FIG. 13, which is taken across the thickness of the panel, the location of thickness of the reinforcement member B is indicated in broken lines, with its end edge preferably welded to the bottom wall 16 of the edge plate C. The edge plate C may extend the full thickness of the panel.

However, because metal is a good thermal conductor it provides a path for the transmission of heat, thus to some extent detracting from the normal and desired thermal insulating character of the panel. The edge plate embodiment of FIG. 13 eliminates that disadvantage. There the edge plate C is centrally located at the top and bottom edges of the panel but has a length less than the thickness of the panel although greater than the thickness of the reinforcement member B, and the low density material 2 at the upper and lower ends of the panel, preferably as molded, encompasses the reinforcement member B but does not extend all the way to the side edges of the panel, leaving gaps 25 at the front and the rear of the edge plate C. Those gaps 25 will be substantially filled with the low density material either during the molding process or afterwards, so that there is no continuous metal path for heat conduction from the front of the panel to its rear surface, as there would be if the edge plate C extended the full thickness of the panel. As a result use of the edge plate C of FIG. 13 provides better heat insulation than when the edge plate C extending the full thickness of the panel is employed. The edge plates C can be formed from conventional metallic building studs which have an appropriate trough-like shape and thus can readily be purchased in commercial markets throughout the world.

Figure 4:
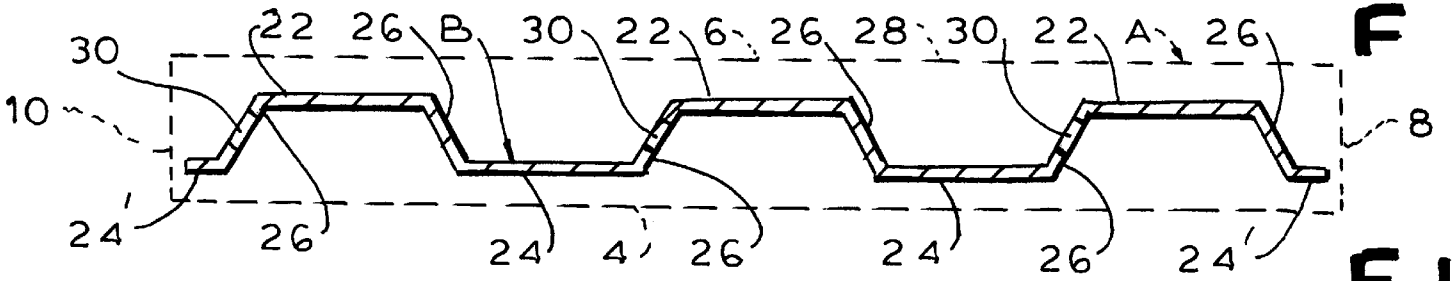
FIG. 4 is a cross-sectional view of one type of reinforcement panel taken along the line 4—4 of FIG. 2.
Figure 5:
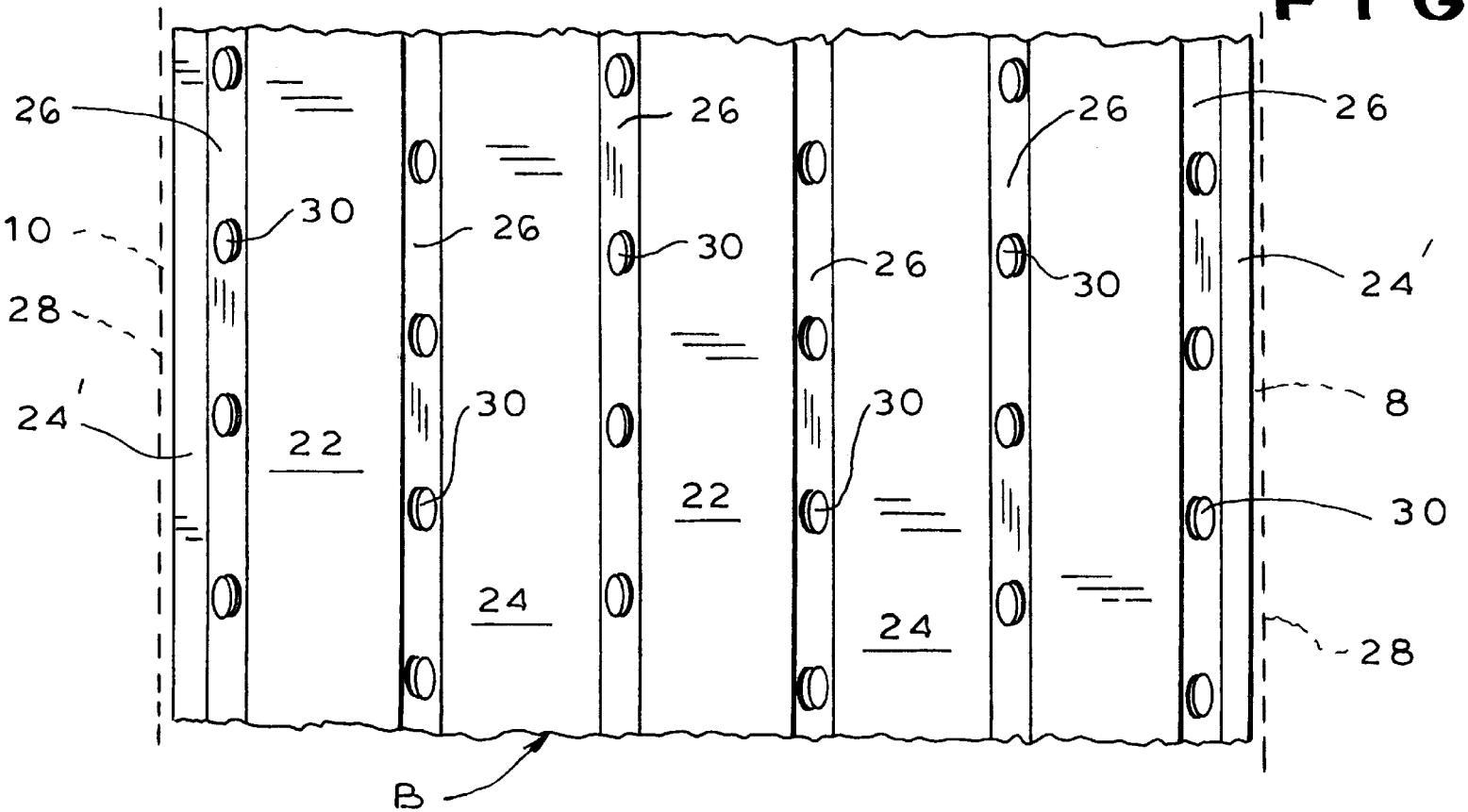
FIG. 5 is a fragmentary front elevation view of the panel of FIG. 4.

FIGS. 2, 4 and 5 illustrate a typical reinforcement member B, which is typically made of metal and provides most of the load-bearing capacity of the panel A. It is shaped to provide first and second sets 22 and 24 of longitudinally extending generally planar segments vertically spaced relative to one another, the adjacent segments of sets 22 and 24 being connected by generally vertically extending segments 26. In the preferred form here disclosed, the segments of sets 22 and 24 are also laterally spaced from one another so that the segments 26 are inclined relative to the thickness of the panel. In FIGS. 4 and 5, the dotted line 28 represents the preferred outline of the low-density material 2 after the overall panel has been formed. In a typical embodiment each of the segments 22 and 24 may have a width of 8 inches, the segments 22 and 24 may be vertically spaced by a distance of 3 inches, and the inclination of the vertically extending panel 26 is about 30 degrees relative to the thickness of the panel. The length of the vertical spacing between the segments 22 and 24, their width, and the inclination of the vertically extending panel 26 may all be varied widely.

The generally vertically extending panels 26 are provided with a series of holes 30 which are relatively large, for example having a diameter of 2½ inches and preferably having a minimum dimension of 2 inches, which are spaced along the length of a given segment 26 by an appreciable distance such as at least 1 foot, with the holes 30 in one inclined segment 26 being staggered lengthwise with respect to the holes 30 of the next adjacent inclined segment 26. These holes 30 permit the low-density material 2 to communicate between the upper and lower surfaces of the reinforcement member B. Significantly, the segments of the sets 22 and 24 are unperforated, without holes, thus retaining their strength-imparting properties, which would deteriorate if holes were provided to any meaningful extent. The sets of segments 22 and 24 extend substantially parallel to the front and rear surfaces 4 and 6 of the panel, and thus are available to receive screws or other fastening devices which pass through some of the low-density material 2 and are screwed into the segment in question, thereby to secure external elements to the panel. While the screw or other fastening device, when used, makes a hole in the generally unperforated segment in question, there is no appreciable decrease in the strength-imparting properties of the reinforcing member B because the screw or other fastening device substantially fills the hole that it makes.

Figure 6:
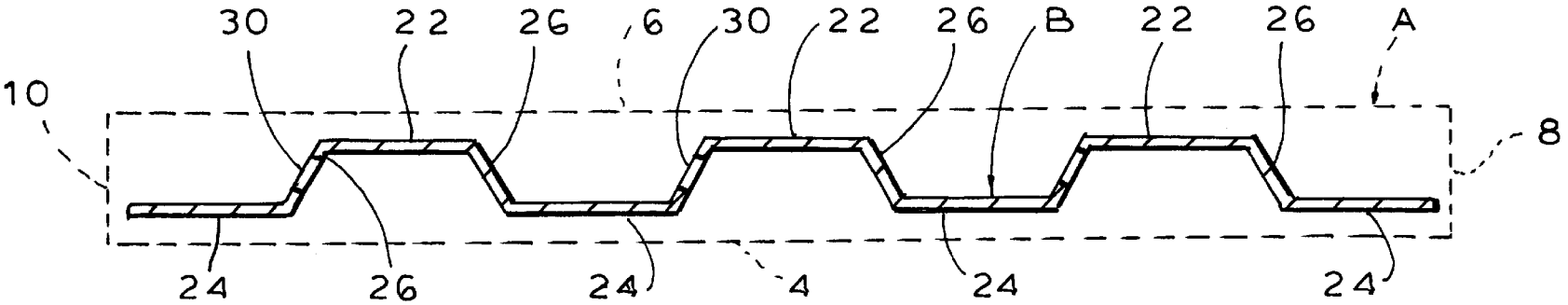
FIG. 6 is a view similar to FIG. 4 but of an alternative embodiment.

The panel of FIGS. 4 and 5 has at its side extremities abbreviated width segment sections 24'. In those instances where external attachment is to be effected close to the sides 8 and 10 of the panel and on, for example, the front face 4 thereof, a reinforcement member of the type shown in FIG. 6 may be employed, which is similar to that shown in FIG. 4 except that the segments 24 at both the left and right hand side extremities of the reinforcement member B are of normal size.

Figure 3:
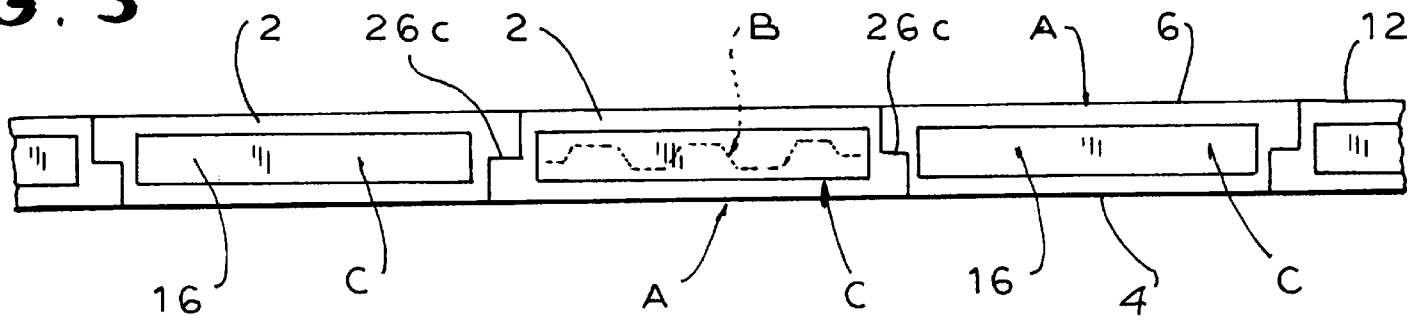
FIG. 3 is a top plan view showing a plurality of the panels of FIG. 1 in aligned and interlocked conditions.
Figure 12:
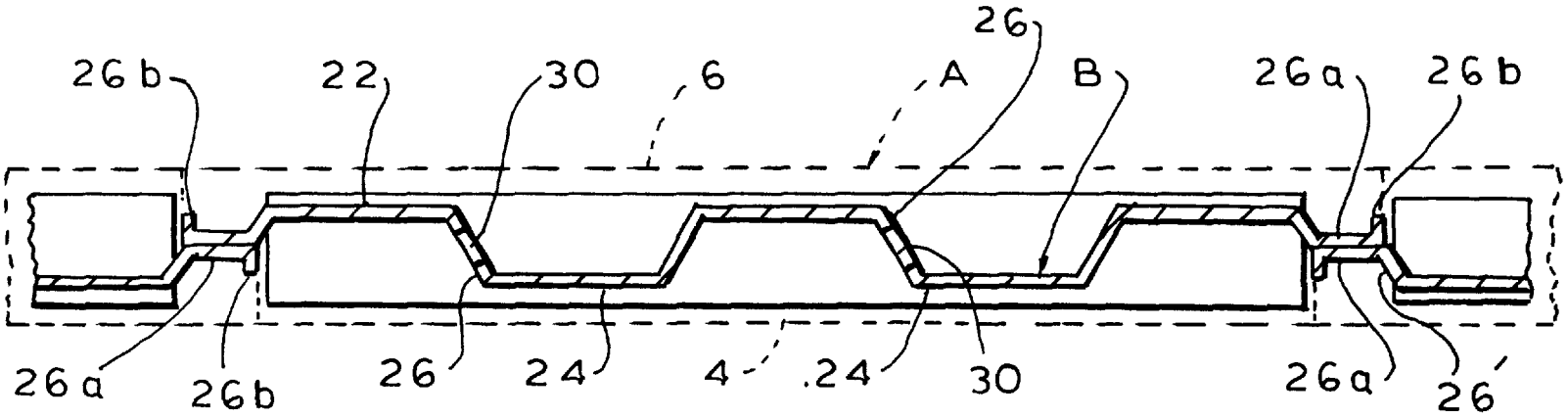
FIG. 12 is a top plan view similar to FIG. 3 but showing interlocked panels with the reinforcement members of FIG. 7.
Figure 7:
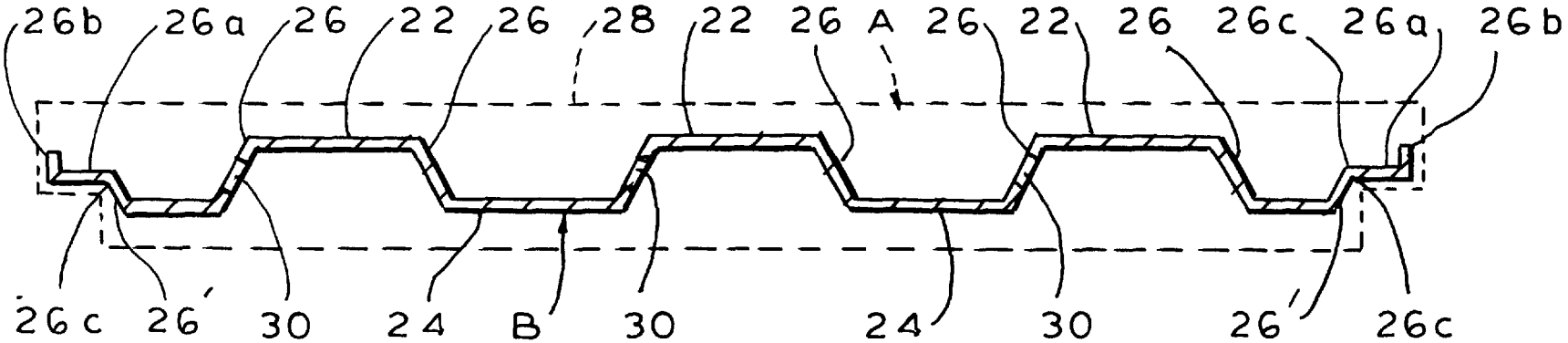
FIG. 7 is a view similar to FIG. 4 but of a second alternative embodiment.

In order to facilitate the obtaining of a seal between adjacent panels the embodiment of FIGS. 7 and 12 may be employed. It differs from the previously described reinforcing member embodiments in that the endmost generally vertically extending segments 26' are only half the length of the segments 26, preferably they are not provided with the holes 30, and horizontal panels 26*a* extend outwardly therefrom, terminating in abbreviated vertical panels 26*b* for rigidification purposes, and the low density material 2, the outline of which is represented by a broken line in FIG. 7, is provided with corner gaps 26*c* at the sides of the panel, which gaps expose the segments 26*a*. Those gaps 26*c* are here shown both at the rear of the panel, but they could be provided one at the front and the other at the rear of the panel. When a plurality of panels of the type disclosed in FIG. 7 are assembled side by side the exposed segments 26*a* overlap, as shown in FIGS. 3 and 12, thus producing a snug and self-supporting joint between the panels. It will be understood that while the segments 26*a* are described as "exposed", they may be covered to some thickness by any suitable material, such as the low density material 2, provided that they are appropriately vertically located to produce the mating overlapping portions described. The panel embodiment illustrated in FIGS. 1 and 3 differs from the embodiment shown in FIGS. 12 and 14 in that the elements 26', 26*a*, 26*b* and 26*c* are either eliminated from the reinforcing member B or else are covered by foamed material so that they are not visible.

Figure 8:
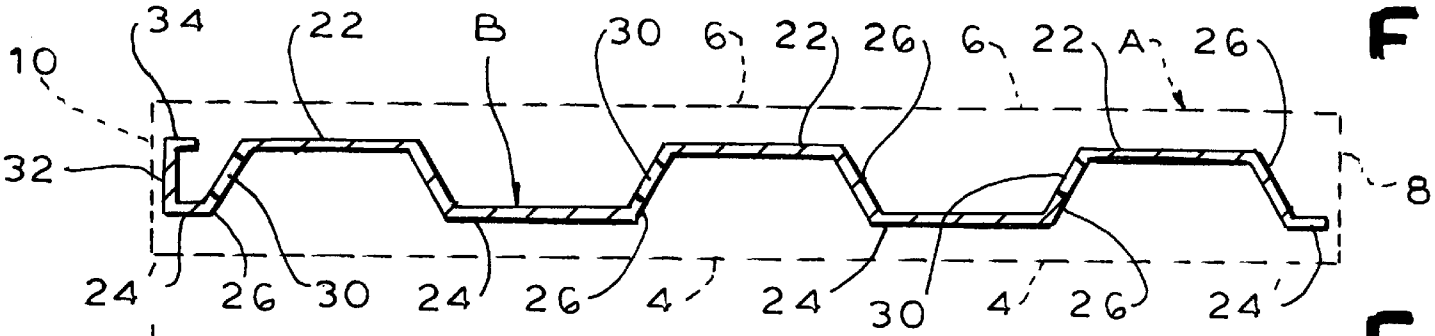
FIG. 8 is a view similar to FIG. 4 but of a third alternative embodiment.
Figure 9:
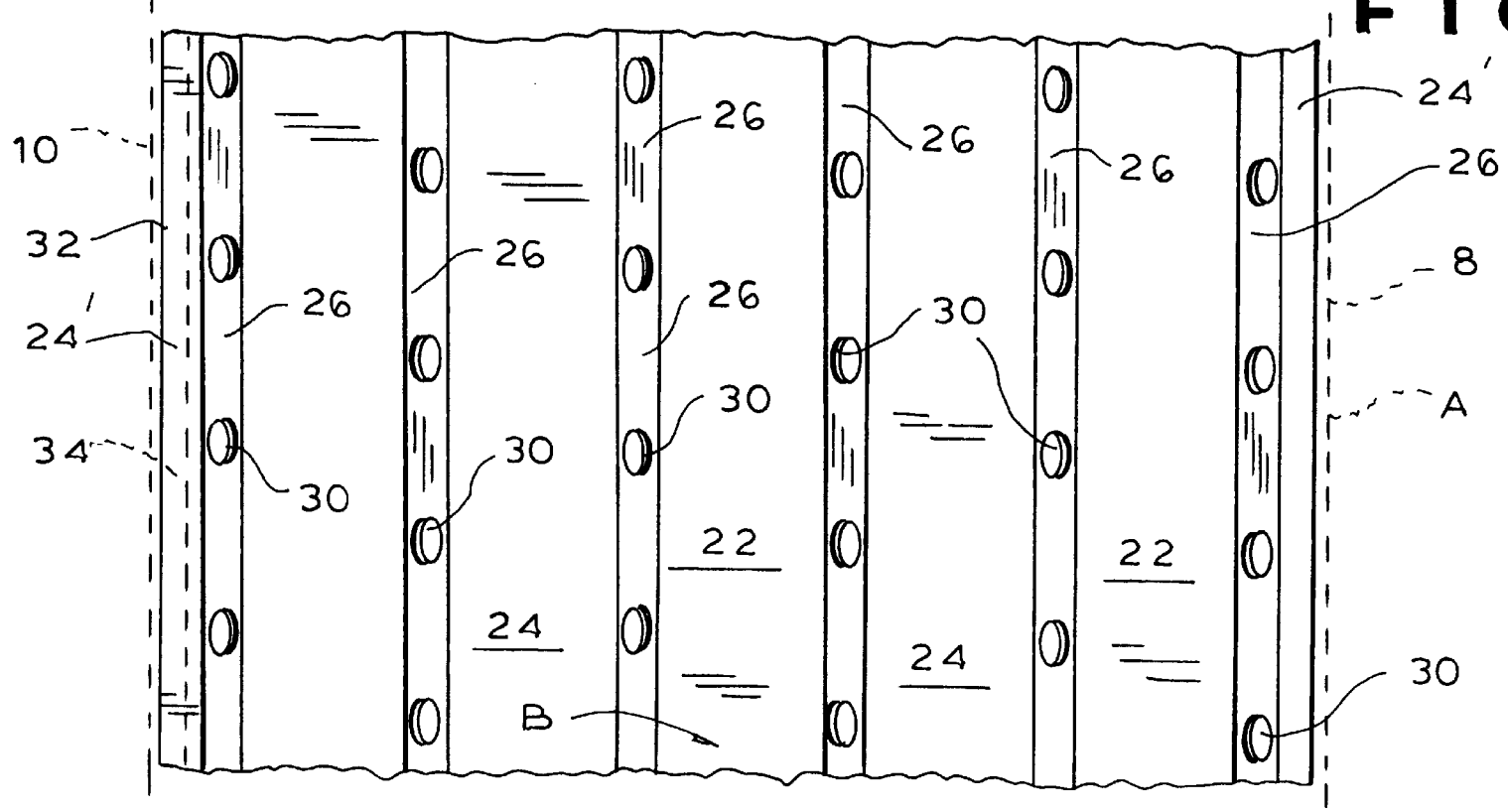
FIG. 9 is a front elevation view of the alternative embodiment of FIG. 8.

Sometimes external attachments to one of the side edges 8 or 10 of the panel is desired. The reinforcement member B of FIG. 8 is designed for that purpose. One side edge of the member B is provided, along one part of the length thereof, with an upstanding wall 32 with inwardly extending rigidifying flange 34. The structure 32, 34 may be separately fabricated and secured to the member B in any appropriate manner, as by welding.

Figure 10:
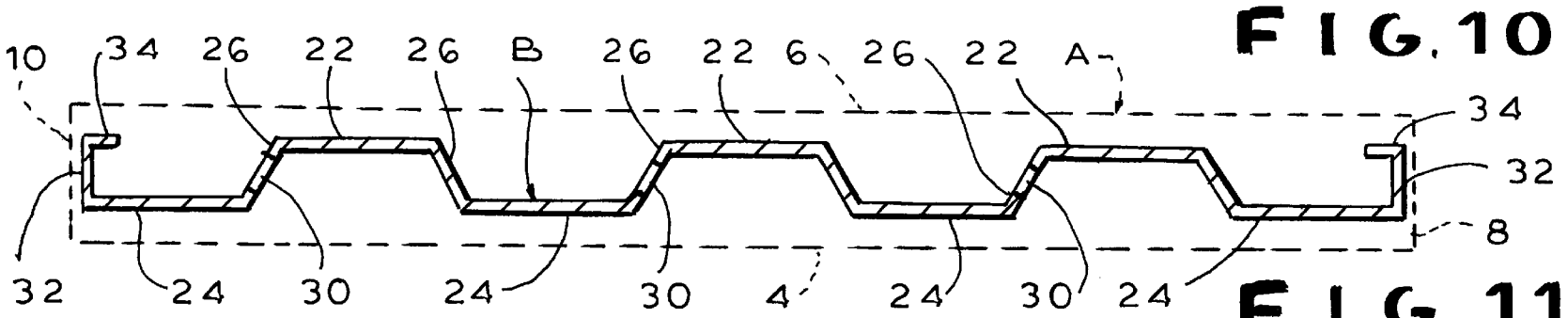
FIG. 10 is a view similar to FIG. 4 but of a fourth alternative embodiment.
Figure 11:
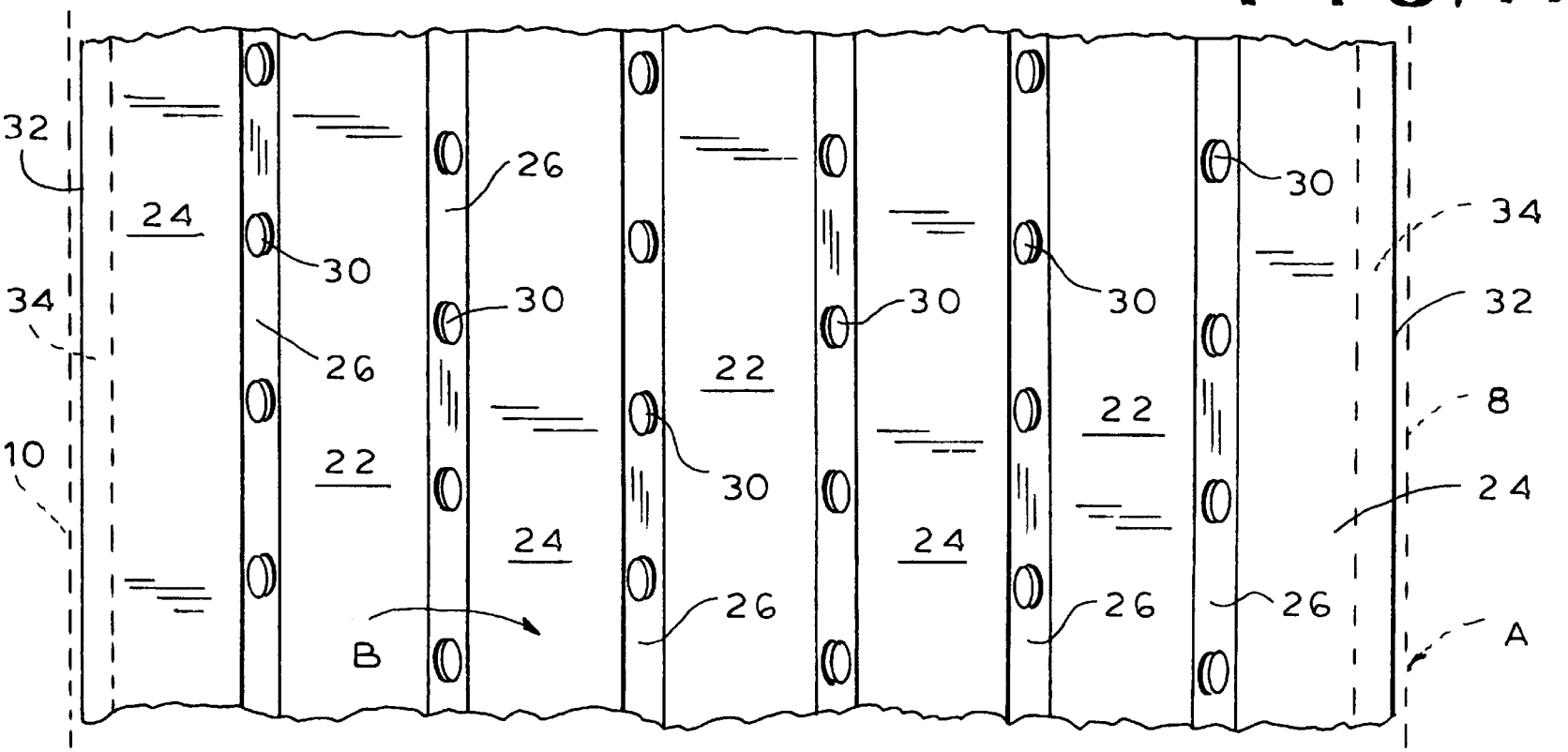
FIG. 11 is a fragmentary front elevation view of the alternative embodiment of FIG. 10.

As shown in FIGS. 10 and 11, if connection to both panel side edges 8 and 10 is contemplated, the reinforcing panel B can be provided with walls 32 with rigidifying flange 34 at both side extremities thereof.

Figure 16:
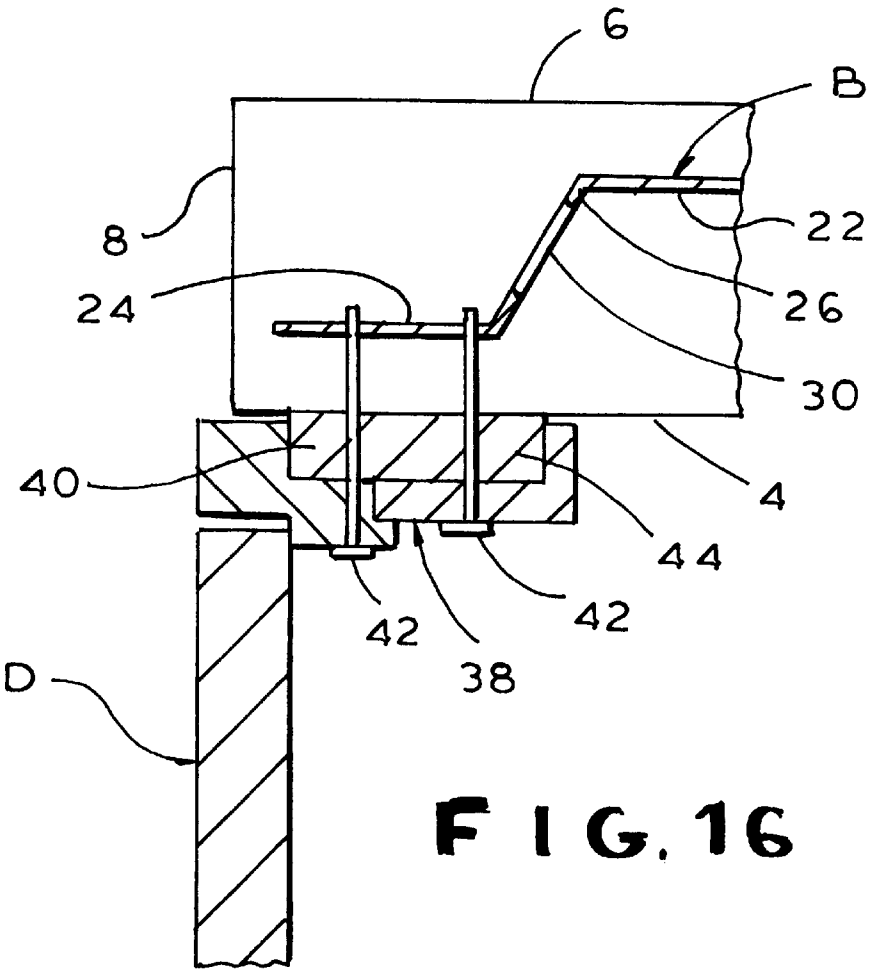
FIGS. 15 and 16 are cross-sectional generally schematic views showing how embodiments of the present invention may be used to secure the panel to external elements such as door jambs.
Figure 15:
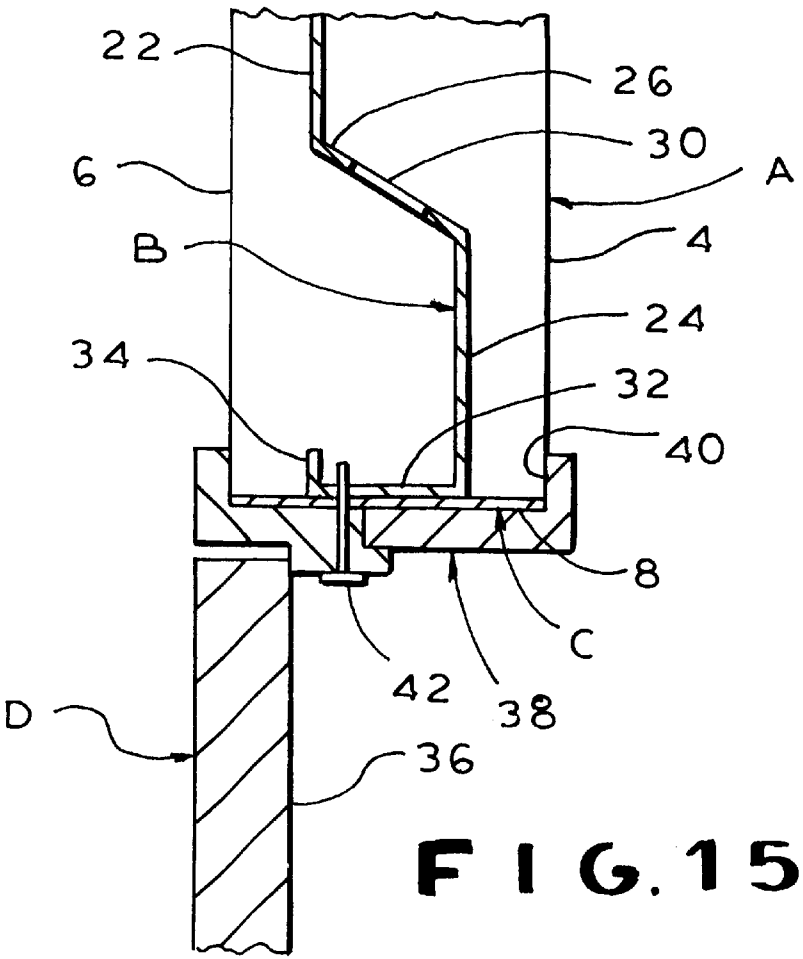

FIGS. 15 and 16 illustrate ways by which external attachment to a panel can be effected. For purposes of illustration, they show two ways in which a door jamb, generally designated D, may be attached. FIG. 15 shows the jamb to be comprised of a movable door 36 and a jamb frame 38 attached to a side edge 8 of panel A. The jamb 38 is provided with an outwardly opening recess 40 into which the panel A fits, and one or more self-tapping screws 42 are driven through the jamb 38 and into and through the upwardly extending wall 32 of the reinforcing member B within the panel A, the reinforcing member B being of the type shown in either FIG. 8 or FIG. 10. When, as is illustrated in FIG. 16, the door jamb D is to be secured to either the front surface 4 or the rear surface 6 of the panel A the outwardly opening recess 40 of the jamb 38 is provided with a filler 44 and the self-tapping screws 42 go through that filler 44, through a portion of the low-density material 2 and into and through the segment 24 at a side extremity of a reinforcement member B of the type shown in FIG. 6.

Figure 17:
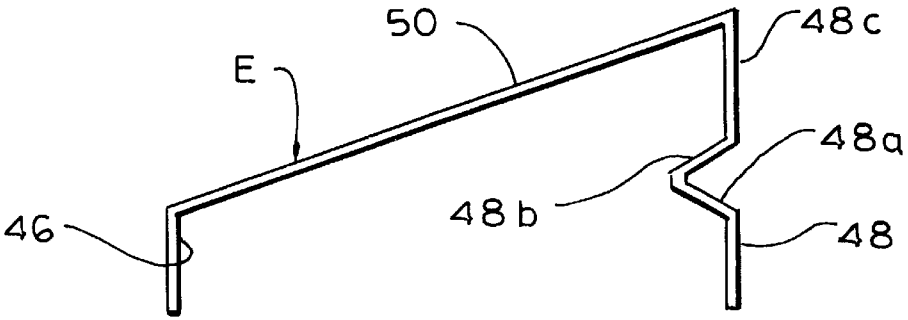
FIG. 17 is a cross-sectional view of a sloped plate used, for example, to attach roof panels to vertical wall panels of the present invention.
Figure 18:
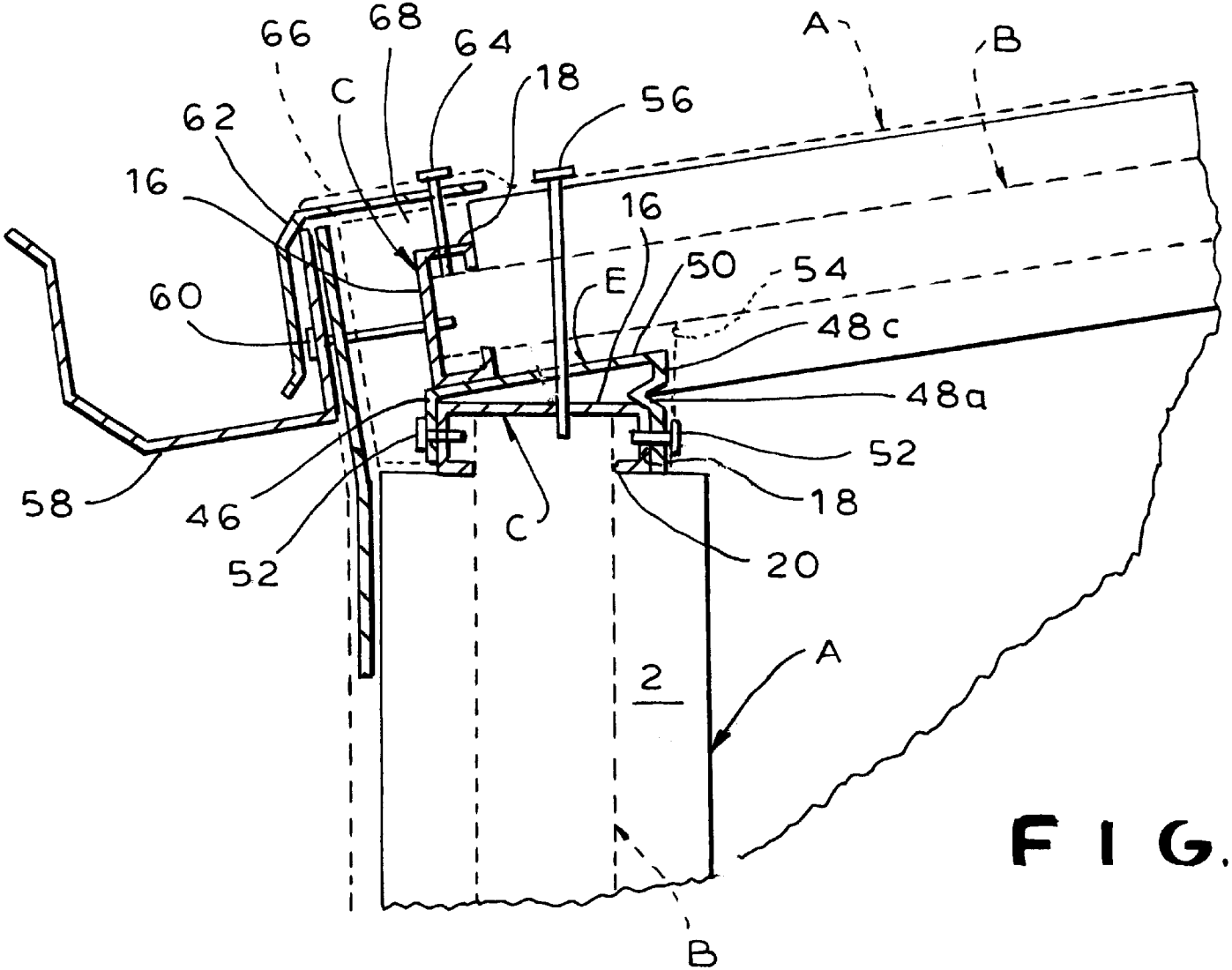
FIG. 18 is a cross-sectional generally schematic view showing one way in which the sloped plate of FIG. 17 may be used.

For securing a panel to the upper or lower edge 12 or 14 of a panel A, and particularly for securing it in an inclined orientation, as might be the case when the panel to be secured is a roofing panel A', a sloped plate generally designated E, such as that shown cross-sectionally in FIG. 17, may be employed. That plate is provided with side walls 46 and 48 connected by top wall 50. As here specifically disclosed for securement to a roofing panel A' sloped at an angle of approximately 20 degrees, the side wall 46 and the lower portion of wall 48 are of similar height and are adapted to fit over the upper end of panel A, as shown in FIG. 18. In order to support the top wall 50 at an angle, the side wall 48 is provided with upward extensions 48*a*, 48*b* and 48*c*, wall sections 48*a* and 48*b* being inclined inwardly to produce an inward obstruction and the wall section 48*c*, together with the wall extensions 48*a* and 48*b*, giving the desired inclination to the top wall 50. The walls 46 and 48 may be secured to edge plate C of the panel A by means of self-tapping screws 52. As here illustrated, the "roof" panel A' is secured to the panel A by removing additional foamed material from the lower corner of the panel A' to produce an enlarged recess 54 into which the upward end of the wall panel A with sloped plate E attached fits. Self-tapping screws 56 are driven through the low-density material 2 of the panel A', the reinforcing member B and the sloping top wall 50 of the sloped plate E in order to secure the panels A and A' to one another.

To further indicate the flexibility and adaptability of the instant construction, a rain gutter 58 is shown secured to the edge plate C of the panel A' by means of self-tapping screws 60, and galvanized iron flashing 62 is secured to the reinforcement member wall 34 by means of self-tapping screws 64. A fiber glass mesh indicated by the dotted line 66 can cover the exposed surfaces on panel A and A'. A mass 68 of foam or other heat-insulated material may be interposed between the end of the roofing panel A' and the other elements disclosed at that end, also entering the corner gap at the upper corner, thereby to improve heat insulation.

It will be understood that the reinforcing member segments 22 and 24 as well as the upstanding edge walls 32 with their associated flanges 34 can be used for the attachment of panels A to structures other than the door jambs illustrated in FIGS. 15 and 16, and that any other objects in addition to rain gutters and flashings may be attached to the panels A, all by utilizing sections of the reinforcing member B which are preferably generally planar and imperforate and which when thus utilized do not have their strength-producing character reduced significantly if at all. The holes 30 in the generally vertically extending segments 26 are relatively large, thus permitting free flow of the low-density material 2 from one side of the reinforcement member B to the other during molding, but they do not adversely affect the strength-giving properties of the generally planar and horizontal reinforcement member segments 22 and 24. The fact that the exposed surfaces of the panel, and particularly the front and rear surfaces 4 and 6 thereof, are defined by a substantial thickness of the low-density material 2 not only improves the wear and environmental resistance of the panel but also provides an appreciable thickness of material into which grooves may readily be cut to provide pathways for plumbing or electrical wiring.

When panels are provided with the overlapping side edge structure of the embodiment of FIGS. 2 and 7 effective and self-supporting joints between adjacent panels are efficiently produced. When edge plates C of abbreviated width such as are shown in FIG. 13 are employed, heat transmission through the panel is improved.

Panels A of the present invention may be transported as completely assembled panels, or in partially assembled form. Preferably edge plates C, as well as the metal member B, will be configured to nest during transport. Thus, the elements B and C can be readily transported from a production facility in one location (such as in the United States) to a finishing facility in a distant location (such as in a country abroad) as unassembled parts. Individual members B can then be assembled with edge plates C at the finishing facility and a low-density material can be there provided to encapsulate members B and complete formation of the panels A. Panels A can then be transported to building sites local to the finishing facility for utilization in building construction. Alternatively, panels A can be completely constructed at a production facility and shipped worldwide from the production facility. As another alternative, edge plates C can be joined to members B at a production facility to form member-and-cap assemblies. Those assemblies can then be transported worldwide to finishing facilities for subsequent incorporation with low-density materials to produce panels A.

Panels of the present invention are particularly effective for the construction of low-cost housing and other buildings, but it will be apparent that they have many other valuable applications. They provide exceptional strength while at the same time facilitating attachment to one another and to external objects. They are readily manufactured at exceptionally low cost and are particularly designed for shipment in component form to remote locations. The embodiments here illustrated have been chosen to illustrate the flexibility of design and use inherent in the present invention, but it will be understood that they are exemplary only, that various of the disclosed features may be combined in different ways, and that many variations may be made therein, all within the scope of the invention as defined in the following claims.

We claim:

1. In a building panel having length, width and thickness and comprising a metal reinforcement member embedded in a low density material, said panel having front and rear surfaces defined at least in part by said low density material, the improvement which comprises said metal reinforcement member comprising first and second sets of lengthwise-extending segments, arranged widthwise of said panel and respectively at elevations thickness-wise of said panel differing by a distance less than the thickness of said panel, the segments of each set being connected to adjacent segments of the other set by generally vertically extending segments, and said metal reinforcement member carries on at least a portion of at least one of its widthwise extremities a vertically extending wall of vertical size substantially equal to the difference in vertical spacing between said lengthwise-extending segments whereby said vertically extending wall can be used for attaching external elements to the edge of said panel.

2. In a building panel having length, width and thickness and comprising a metal reinforcement member embedded in a low density material, said panel having front and rear surfaces defined at least in part by said low density material, the improvement which comprises said metal reinforcement member comprising first and second sets of lengthwise-extending segments, arranged widthwise of said panel and respectively at elevations thickness-wise of said panel differing by a distance less than the thickness of said panel, the segments of each set being connected to adjacent segments of the other set by generally vertically extending segments, and with a widthwise extremity of said reinforcement member comprising a lengthwise extending segment at an elevation between the elevations of said first and second sets of segments.

3. The building panel of claim 2, having a vertically extending flange at the free edge of said between-elevation segment.

4. The building panel of either of claims 2 or 3 in which a between-elevation segment is provided at both widthwise extremities.

5. The building panel of claim 2, in which at least one of said widthwise extremity segments is substantially exposed.

6. The building panel of claim 2 in which the elevations of said widthwise extending segments are approximately mid-way between the elevations of the segments of said first and second sets respectively.

7. The building panel of claim 6 in which said widthwise extremity segment is substantially exposed.

8. In the building panel of claim 2, widthwise extremity segments at both width ends, each of said widthwise extremity segments being at an elevation approximately mid-way between the elevations of the segments of said first and second sets respectively.

9. The building panel of claim 8 in which the upper surface of said widthwise extremity segments are substantially exposed.

10. In a building panel having length, width and thickness and comprising a metal reinforcement member embedded in a low density material, said panel having front and rear surfaces defined at least in part by said low density material, the improvement which comprises said metal reinforcement member comprising first and second sets of lengthwise-extending segments arranged widthwise of said panel and respectively at elevations thicknesswise of said panel differing by a distance less than the thickness of said panel, the segments of each set being connected to adjacent segments of the other set by generally vertically extending segments, the upper and lower lengthwise ends of said panel being of a lesser width than the main portion of said panel, thereby defining gaps at the corners of said lengthwise panel end, and metal edge plates on said ends of lesser thickness.

11. The building panel of claim 10 in which said gaps are substantially filled with heat insulative material.

12. In combination with a building panel having a length, width and thickness and comprising a metal reinforcement member embedded in a low density material, said panel having front and rear surfaces defined at least in part by said low density material, the improvement which comprises said metal reinforcement member comprising first and second sets of lengthwise-extending segments, arranged widthwise of said panel and respectively at elevations thicknesswise of said panel differing by a distance less than the thickness of said panel, the segments of each set being connected to adjacent segments of the other set by generally vertically extending segments, said vertically extending segments being provided with holes spaced lengthwise therealong, said segments of said first and second sets being substantially free of holes, an edge plate secured to a lengthwise end of said metal reinforcement member, an adapter plate having side walls fitting over said lengthwise end and having an inclined top wall, and securing means securing together said adapter plate side walls and said edge plate.

13. The building panel of claim 12, in which the segments of said first and second sets of segments are substantially planar.

14. The building panel of claim 12, in which said generally vertically extending segments are inclined relative to the thickness of said panel.

15. The combination of claim 12, in which said adapter plate has first and second side walls depending from the higher and lower ends of said inclined top wall respectively, one of said side walls having a stop means extending inwardly substantially in line with said lower end of said top wall thereby to support said adapter plate on said panel and in desired spatial relationship thereto.

16. The combination of claim 15, in which said stop means comprises an inwardly bent portion integral with one of said side walls.

17. The combination of claim 12, in which said adapter plate has first and second side walls depending from the higher and lower ends of said inclined top wall respectively, said first side wall having stop means extending inwardly substantially in line with said lower end of said top wall, thereby to support said adapter plate on said panel end in desired spatial relationship thereto.

18. The combination of claim 17, in which said stop means comprises an inwardly bent portion integral with said first sidewall.

* * * * *